US005201365A

United States Patent [19]

Siegel

[11] Patent Number: 5,201,365

[45] Date of Patent: Apr. 13, 1993

[54] WEARABLE AIR CONDITIONERS

[76] Inventor: Israel Siegel, 2980 Point East Dr., Apt. D-612, N. Miami Beach, Fla. 33160

[21] Appl. No.: 637,666

[22] Filed: Jan. 7, 1991

[51] Int. Cl.[5] ..... F25D 3/12; A61F 7/02

[52] U.S. Cl. ..... 165/46; 165/104.21; 62/259.3; 62/333; 62/4; 128/400

[58] Field of Search ..... 62/259.3, 333, 4; 165/46, 104.21

[56] References Cited

U.S. PATENT DOCUMENTS 2,648,325 8/1953 Siple ..... 165/46
3,738,702 6/1973 Jacobs ..... 165/46
4,296,796 10/1981 Siple ..... 165/46

*Primary Examiner*—Albert W. Davis, Jr.

[57] ABSTRACT

The invention consists of a cooling system that can be worn and travel with the person using the cooling system. Flexible inter-communicating containers (such as coils), are adapted to fit body contour and function as heat removers. The containers are incorporated into clothing, or applied directly to the body. Water under a vacuum in the containers boils at low temperature and removes body heat. Vapor generated by the boiling water re-condenses into water in a communicating portable cold container, which is cooled by portable ice packs, or by endothermic chemical reactants. The degree of cooling can be controlled by regulation of the degree of the communication between the the heat remover containers and the cold condenser container. The re-condensed water returns spontaneously to the heat remover containers by force of gravity. The cooling device can be incorporated into any object which forms a direct or an indirect contact with a person using the device, such as medical casts, and cold compresses.

10 Claims, 2 Drawing Sheets

WEARABLE AIR CONDITIONERS

BACKGROUND AND OBJECTIVES

The invention relates to cooling devices and in particular to a cooling system that can be incorporated into clothing, or applied directly to body surfaces. Existing air conditioning systems are designed to cool building spaces and can not be conveniently used to cool an individual who moves outdoors. One objective of the present invention is to provide a cooling system which is wearable and can contribute to the comfort of a person both indoors and out doors.

Another objective of the invention is provide a direct cooling of people and, thus, save the energy required for space cooling.

A third objective consists of increasing the safety of workers, such as fire fighters, who must work under life threatening high temperatures.

Another objective is to provide an improvement in medically prescribed cooling. For example, the invention can provide a direct cooling of patients with excessively high fever. The cooling system can likewise be used for casts and compresses. One of the side effect of casts, which enclose a body portion for long periods, is the fact that the casts act as insulators and reduce the natural heat loss from parts of the body enclosed by the casts. An objective of this invention is to incorporate a low cost temperature-adjustable cooling system in the cast, and thus reduce an excessive heat accumulation in the body portions enclosed by the cast.

Another medical objectives consists of the provision of cold compresses which can be temperature regulated. Existing cold compresses consist of ice packs. The temperature of the ice can not be changed and is too cold for prolonged application. The present invention provides compresses with any desired intermediate ice to body temperatures.

SUMMARY

The invention consists of cooling systems that can be incorporated into clothing, or applied directly to portions of a human body which require cooling. The basic components of the invention are as follows. 1. A network of inter-communicating containers which are worn like a garment, and function as body heat removers. The heat remover containers contain water and an air vacuum to lower the boiling point of the water. The water boils at lower than ambient temperature and removes body heat. 2. A portable cold container to recondense the vapor generated by the boiling water. 3. A cooling agent such as portable endothermic chemical reactants, or portable pre-frozen ice packs, to cool the condenser container. 4. A system of communications to obtain a continuous and spontaneous cooling water-vapor cycle. This communication consists of the follows. The condenser container is carried at a higher level than the water level in the heat remover container. A flexible tube communicates between the top portions of the heat remover and the condenser containers to conduct vapor generated in the heat remover to the condenser container. Another tube communicates between the bottom portions of the heat remover and the condenser containers to return, by force of gravity, the re-condensed water to the heat remover container.

The air vacuum in the heat remover container causes the water in the heat remover containers to boil at lower than ambient temperature. As the water boils it cools its surroundings and absorbs body heat. The vapor generated by the boiling water enters the cold condenser container and re-condenses into water by the relatively the cold temperatures in the condenser container. The water returns to the heat remover containers by force of gravity to continue the cooling water-vapor cycle of action. The rate of cooling is regulated by adjustment of the degree of opening of the communications between the heat-remover and the condenser containers.

Specialized adaptations of the invention include cooling insulated fire fighting clothing, cooling medical casts and bandages, and temperature regulated cold compresses.

DETAILED DESCRIPTION

Figure 1:
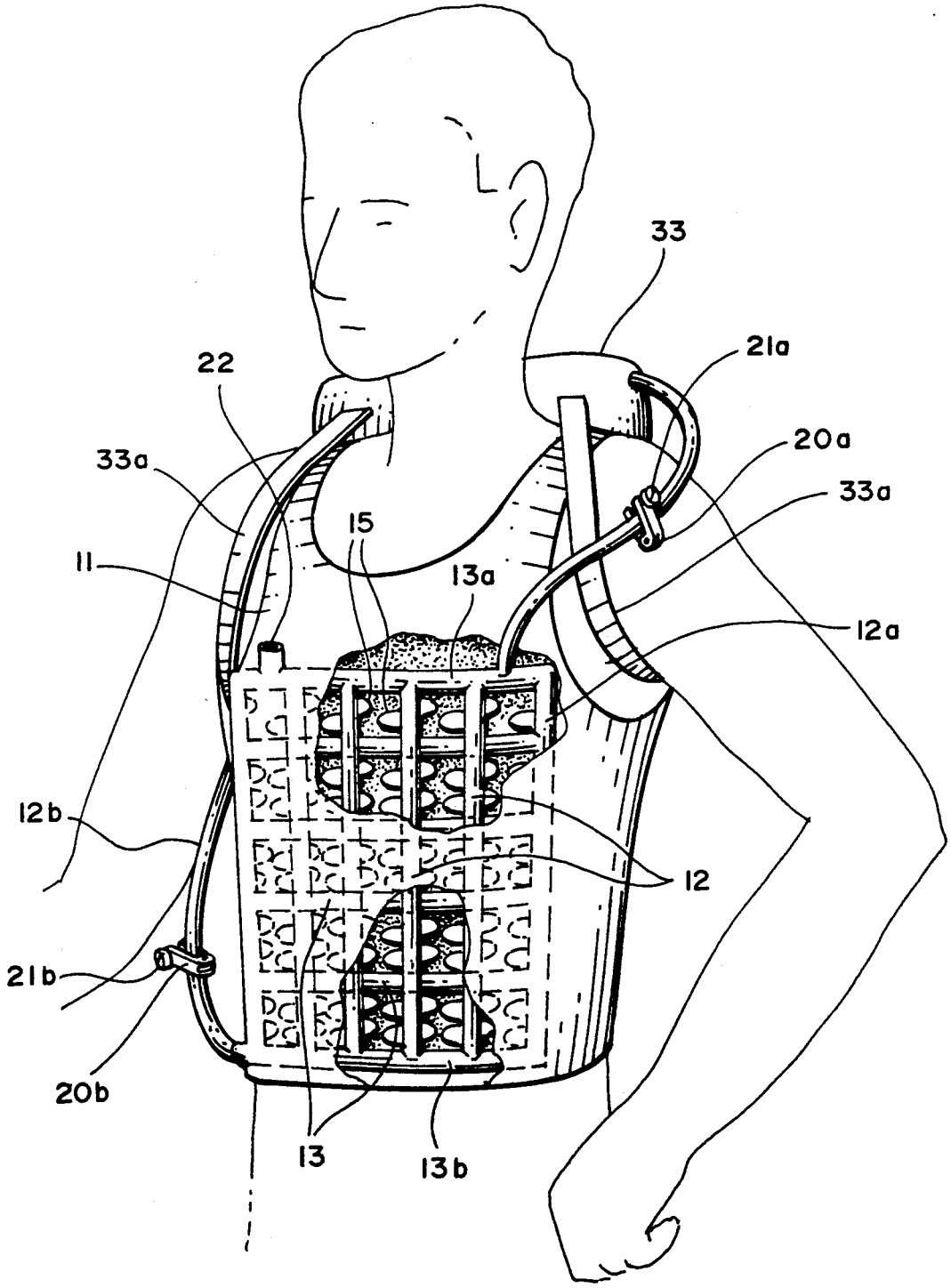
FIG. 1 is a three dimensional front view of a wearable air conditioner.
Figure 2:
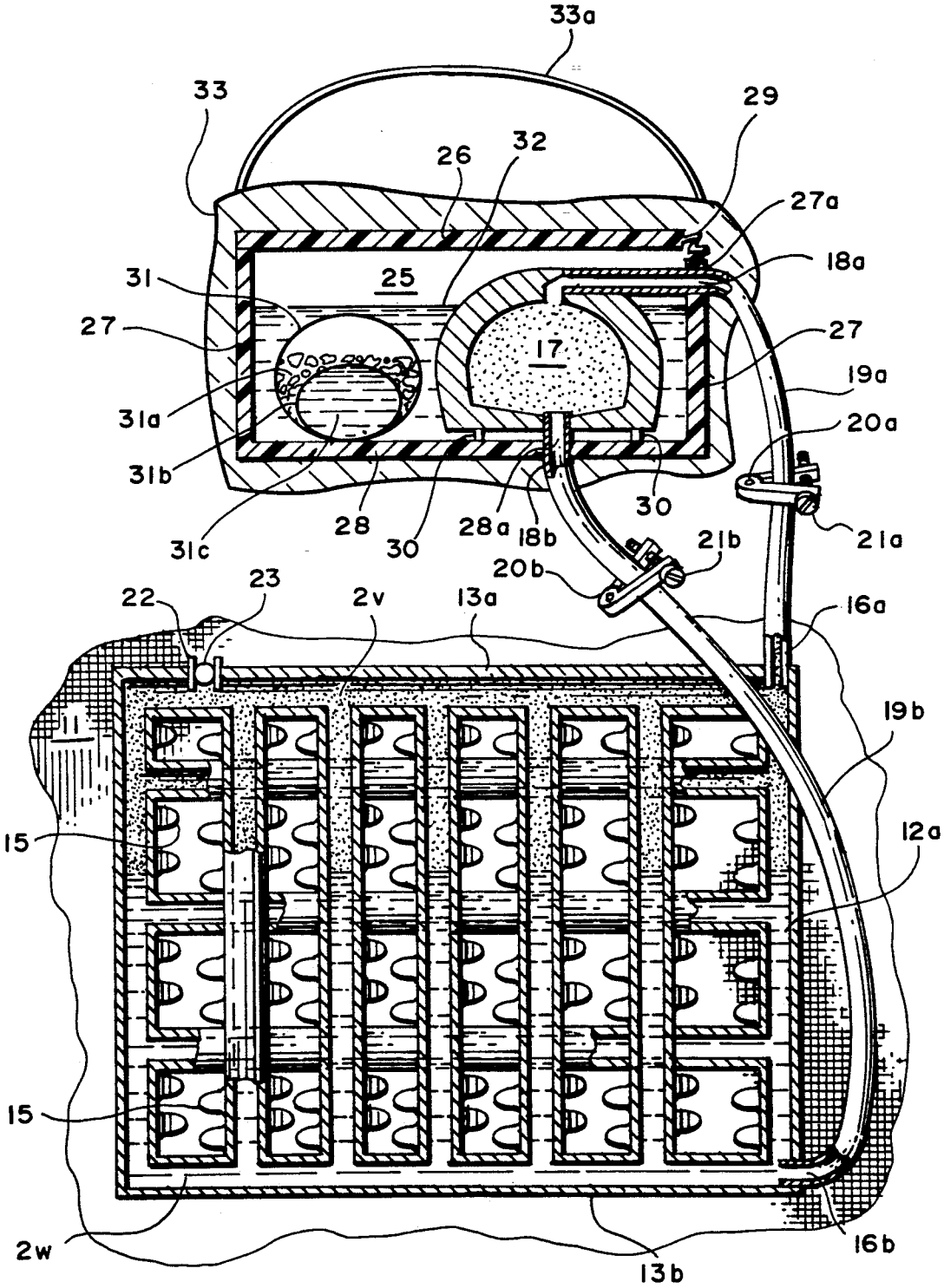
FIG. 2 is a cross sectional view of an embodiment of a wearable air conditioner.

FIG. 1 and FIG. 2 illustrate the basic structures of an embodiment of a wearable air conditioner. As shown in the figures, there is present a series of vertical tubes 12, and horizontal tubes 13. The arrangement is that the all the vertical tubes tubes communicate with the top horizontal tube 13*a*, and the bottom horizontal tube 13*b*. All the horizontal tubes open into a side vertical tube 12*a*. The tubes 12–13 serve as heat remover tubes and as an evaporator chamber as will be described. The heat remover tubes have a very large surface volume ratio, are flexible, and shaped to fit body contour. For example, tubes 12–13 may consist of flexible intercommunicating nylon coils incorporated in, or attached to, the fabric of an undershirt 11. Extending from tubes 12–13 are flat heat conducting extensions 15. The extensions are cooled by tubes 12–13 and increase the area of the heat removing surfaces. The extension 15 may be made of a light weight heat conducting material such as a metal foil. Communicating with the top horizontal tube 13*a* is an outlet tube 16*a*. Communicating with bottom horizontal tube 13*b* is an inlet tube 16*b*. Also communicating with the top horizontal tube 13*a* is outlet and inlet tube 22. A valve 23 opens and closes tube 22. When open, the tube 22 forms a communication between tubes 12–13 and the outside environment. Present inside tubes 12–13 are an air vacuum and water 2*w*. The arrangement is such that water is introduced into tubes 12–13 through tube 22 after the air has been evacuated from the system, as will be described. The amount of water introduced into tubes 12–13 is such that the water level in the tubes 12 reaches about one half to two thirds of the height of the tubes. The water level thus defines a water phase 2*w* in the bottom portions of the tubes, and a vapor phase 2*v* in the top portions of the tubes.

Present at a higher level than the water level in tubes 12–13 is a container 17. As shown in the FIG. 2, the container is shaped, in part, like a dome. The arrangement is that the direction of the walls is always downward to ensure a gravity induced drainage of any liquid in the container. The container 17 serves as a cold condenser chamber, as will be described. The chamber is made of good heat conducting material such as aluminum.

The condenser container 17 is placed inside a container 25. The container 25 is made from good insulating material, such as plastic, to minimize warming of container 25 by environmental heat. The container 25 has top wall 26, side walls 27, and bottom wall 28. The arrangement is that top wall 26 is attached only to one of side wall 27 through flexible hinge means 29. This allows wall 26 to swing from a horizontal to a vertical position and to open and close container 25. The natural bias in the spring of hinge 29 is to keep wall 26 in its horizontal position and keep container 25 tightly closed. Extending from bottom wall of container 25 are extensions 30. The extensions are designed to form a support for condenser chamber 17, and to immobilize the condenser chamber in a permanent position in container 25. To that end the condenser chamber 17 is permanently attached to extensions 30. Inlet tube **18*a* opens into the top portion of condenser chamber 17. Outlet tube 18*b* opens into the bottom portion of condenser chamber 17. The tubes 18*a* and 18*b* open into the outside of condenser chamber 17 and the outside of container 25. To that end the tube 18*a* exits container 25 through an opening 27*a* in an upper portion of side wall 27 of container 25. The tube 18*a* fits tightly in opening 27*a* to prevent any leakage through 21*a*. Sealing material (not shown) may be used to assure a leak-proof opening. Tube 18*b* exits container 25 through an opening 28*a* in bottom wall 28 of container 25. The tube 18*b* fits tightly in opening 28*a* to prevent any leakage through 28*a*. Sealing material (not shown) may be used to assure a leak-proof opening. Flexible tube 19*a* forms a communication between tubes 16*a* and 18*a*. Flexible tube 19*b* forms a communication between tubes 16*b* and 18*b*. Present on flexible tubing 19*a* is clamp 20*a*. Present on flexible tubing 19*b* is clamp 20*b*. Screw 21*a* regulates the width of the clamp 20*a*. Screw 21*b* regulates the width of the clamp 20*b*. The arrangement is that as the width of the clamps is narrowed they tighten around tubes 19*a* and 19*b* and reduce the diameter of the tubes. When the width of the clamps is widened the pressure upon the tubes is reduced and the natural flexibility of tube 19*a* and 19*b*** causes the diameter of the tubes to widen and reach their natural size.

Present inside container 25 is a replaceable cooling agent. The cooling agent consists of a plastic bag 31, which contains 2 chemical components that produce a heat absorbing endothermic reaction when mixed. The chemicals are separated when not in use. For example, bag 31 may contain ammonium nitrate granules **31*a*, and a bag 31*b* containing containing water 31*c*. The arrangement is that the walls of bag 31 are stronger than the wall of the bag 31*a*. When a cooling effect is desired pressure is transmitted to bag 31*b* through the walls of bag 31. This causes bag 31*b* to tear and to release the water into bag 31. This would allow the water 31*c* to to mix with the ammonium nitrate granules in bag 31 and to initiate the heat absorbing reactions. Present in container 25 is water 32. The water immerses bag 31 and condenser chamber 17. This facilitates the transfer of heat from condenser chamber 17 to bag 31. This serves to keep the condenser chamber 17 cold, as will be described. Container 25 is placed in a back pack 33. The pack 33 is carried, at a higher level than tubes the water level in 12–13, through straps 33*a*** on the back of the person wearing the cooling system.

The operation of the device by the person wearing the device is as follows. To initiate cooling activity top wall 26 is opened and bag 31 is removed from container 25. Pressure is then exerted on bag 31 to tear the walls of bag **31*b*. This initiates the endothermic heat absorbing reactions in bag 31. The bag 31 is then put back in container 25. The top wall 26 is then closed. The user then wears the garment and carries the container 25 on the back with back pack 33. Clamps 20*a* and 20*b* are in their open positions to open tubes 19*a* and 19*b*. The fact that pack 33 with condenser 17 is carried at a higher level than tubes 12–13 would cause any liquid which may be present in condenser chamber 17 to drain into tubes 12–13. The vacuum in tubes 12–13 in the system causes the water 2*w* to boil at relatively low temperatures. The vapor which is generated in the evaporator tubes 12–13 enters the vapor phase 2*v* in tubes 12–13 and condenser container 17. The cold pack 31 in container 25 causes the temperature in condenser chamber 17 to be lower than the temperature in the evaporator tubes 12–13. The vapor pressure of the vapor which has entered container 17 from the evaporator tubes 12–13 can not be maintained in the relatively cold condenser chamber, and the part of the vapor in container 17 will re-condense into water. This causes the water vapor pressure in the condenser chamber 17 to be lower than the vapor pressure in the evaporator tubes 12–13. This vapor pressure differential causes additional vapor in tubes 12–13 to enter condenser chamber 17. More vapor will then be generated in tubes 12–13 to replace the vapor which has re-condensed in container 17. Thus, the water in tubes 12–13 will boil continuously as long as the the temperature in container 17 is lower than that of tubes 12–13. The condensed water returns spontaneously to the heat remover tubes 12–13 through tube 19*b*** by the force of gravity.

The boiling of water **2*w* in the evaporator tubes 12–13 cools the water in the tubes to the water's relatively low boiling temperature. The cold water absorbs heat from tubes 12–13. The relatively cold tubes then remove heat from extensions 15 and garment 11**. The cool garment will then remove heat from the person wearing the garment.

It is understood that that the cooling agent may consist not only of endothermic chemical bags but of any portable means that cause a cooling effect. For example, the cooling agents may consist of replaceable and renewable ice packs. The ice-packs will be renewed by insertion into standard freezers.

The wearable air conditioner may be used not only for comfort, but may be adapted for for use for a variety of specialized purposes. For example, the device may be incorporated into insulated clothing of fire fighters to extend the fire fighters' range of operation.

The device may likewise be adapted for use for medical devices which are applied to the body for cooling purposes. For example, the heat remover tubes 12–13 may be incorporated into pads which can be used as cold compresses. The temperature of the pads may be adjusted, according to the individual need of the patient, by clamp 20. Alternatively, tubes 12–13 may be adapted to be applied directly to areas of the body required cooling.

The heat remover coils may be incorporated not only in compresses but also in casts to help remove heat from the areas of the body insulated by the cast. The casts may be prepared as follows: Materials use to prepare the cast, such as Plaster of Paris is mixed with water to obtain a wet cement. The cement is then layered on the bandage enclosing the body portion requiring the cast. Tubes 12–13 are then placed on the layer of the cement on the bandage. Additional wet cement is then applied to the bandage to complete the cast and to cover tubes 12–13. Thus, tubes 12–13 will be placed inside the cast, between the cement layers during cast preparation.

When the Plaster of Paris hardens tubes 11–14 will be fixed inside the cast.

It is understood that the above specialized applications of the wearable cooler are given as examples, and other adaptations may be made without departing from the essence of the invention as described in the claims.

The air vacuum in the wearable air conditioners may be induced, before water is introduced into tubes 12–13, as follows. It is understood that other methods of inducing a vacuum may be used without departing from the essence of the invention. Clamps 20*a* and 20*b* and valve 23 are put in their open position. Tube 22 is then connected to a vacuum pump (not shown), and air is evacuated from the evaporator and condenser systems. Valve 23 is then closed and tube 22 is disconnected from the vacuum pump. Tube 22 is then connected to a water source (not shown). Water is then introduced into tube 22 while valve 23 is closed, and trapped air is eliminated from tube 22. Valve 23 is then opened and water 24 is introduced into tubes 12–13. The amount of water is such that it fills ⅓ to ½ of the tubes 12–13. Valve 23 is then closed and tube 22 is disconnected from the water source.

What is claimed is:

1. An air conditioner said air conditioner includes at least one container to act as a heat remover, said heat remover container having a high surface to volume ratio, a liquid in said heat remover container to act as a low boiling point refrigerant, an air vacuum in said heat remover container to lower the boiling point of said liquid, at least one container to act as a condenser container, means to cool said condenser container, a communication between said heat remover and said condenser containers, said communication including a communication between the vapor phase of said heat remover and said condenser, means to regulate the size of the opening of said vapor communication to obtain different degrees of communication between the vapor phase of said heat remover and said condenser, to control the degree of cooling by said heat remover, and means to return liquid from the condenser to the heat remover containers.

2. The invention as described in claim 1 wherein said heat remover container is adapted to fit body contour.

3. The invention as described in claim 1 wherein said liquid is water.

4. The invention as described in claim 1, and including means to make said heat remover containers flexible.

5. The invention as described in claim 1 wherein means to return liquid from the condenser to the heat remover chamber consist of placing said condenser chamber at a higher level than said heat remover container to cause a spontaneous drainage of condensed liquid from the condenser to the heat remover containers.

6. A wearable and air conditioner, said air conditioner includes at least one container acting as a heat remover, said container having a high surface to volume ratio, a liquid in said heat remover container to act as a low boiling point refrigerant, an air vacuum in said heat remover container to lower the boiling point of said liquid, at least one container to act as a condenser container, means to cool said condenser container, a communication between said heat remover and condenser containers, said communication including a communication between the vapor phase of said heat remover and said condenser, means to regulate the size of said vapor communication to obtain different degrees of communication between the vapor phase of said heat remover and said condenser, and to control the degree of cooling by said heat remover, and means to associated said heat remover container with objects which are used at close proximity to body portions of a person using said wearable air conditioner.

7. The invention as described in claim 6 wherein said objects consist of clothing.

8. The invention as described in claim 6 wherein said objects consist of medical casts.

9. The invention as described in claim 6 wherein said objects consist of cold compresses.

10. A wearable air conditioner said air conditioner includes at least one container having a high surface to volume ratio, to act as a heat remover container, a liquid in said heat remover container to act as a low boiling point refrigerant, an air vacuum in said heat remover container to lower the boiling point of said liquid, at least one container to act as a cold condenser container, means to cool said condenser container, and means to obtain a spontaneous water-vapor cycle, said means consist of placement of said condenser container at a higher level than said liquid level in said heat remover containers, a communication between upper portions of said condenser and said heat remover containers to allow a re-condensation of vapor in said condenser container, and a communication between bottom portions of said condenser and heat remover containers to allow a gravity induced return of said re-condensed liquid from said condenser to said heat-remover containers means to regulate the size of said communication between upper portions to obtain different degrees of communication between the vapor phase of said heat remover and said condenser, and to control the degree of cooling by said heat remover.

* * * * *